United States Patent [19]

Valliere

[11] 3,987,386

[45] Oct. 19, 1976

[54] TUNABLE AIR COIL INDUCTOR

[75] Inventor: Edward G. Valliere, Roslyn, Pa.

[73] Assignee: American Electronic Laboratories, Inc., Colmar, Pa.

[22] Filed: Apr. 18, 1975

[21] Appl. No.: 569,218

[52] U.S. Cl. ..... 336/20; 72/138; 140/92.2; 336/180; 336/192; 336/222

[51] Int. Cl.[2] ..... H01F 21/04

[58] Field of Search ..... 336/180, 192, 20, 222, 336/225, 223; 219/275; 72/138, 135; 338/143, 62, 63, 298, 299, 330, 326; 313/344; 267/166, 180, 167, 182, 168; 140/92.2, 71 C, 89, 103, 124

[56] References Cited

UNITED STATES PATENTS

| | | | |
|---|---|---|---|
| 1,157,995 | 10/1915 | Mackay | 313/344 |
| 1,824,585 | 9/1931 | Wolcott et al. | 219/275 X |
| 2,229,717 | 1/1941 | Brace et al. | 338/63 X |
| 2,456,076 | 12/1948 | Ofeldt | 336/192 X |
| 2,497,516 | 2/1950 | Phelps | 336/192 X |
| 2,547,865 | 4/1951 | Hanks | 219/275 |
| 2,941,172 | 6/1960 | Sutton, Jr. | 336/192 X |
| 3,119,084 | 1/1964 | Sutton, Jr. | 336/192 X |

FOREIGN PATENTS OR APPLICATIONS

| | | | |
|---|---|---|---|
| 2,006,172 | 8/1971 | Germany | 336/180 |

*Primary Examiner*—Thomas J. Kozma
*Attorney, Agent, or Firm*—Jacob Trachtman

[57] ABSTRACT

The inductor coil includes two helical wire coil sections, one within the other. The coil sections are integral at one end of the coil and have terminals at the other end extending parallel to the longitudinal axis of the coil. The coil is wound from a single length of wire on an apparatus which permits winding of one of the coil section around the other section.

4 Claims, 5 Drawing Figures

FIG. 1
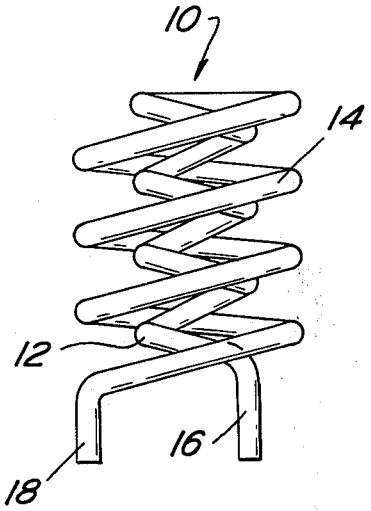
FIG. 2
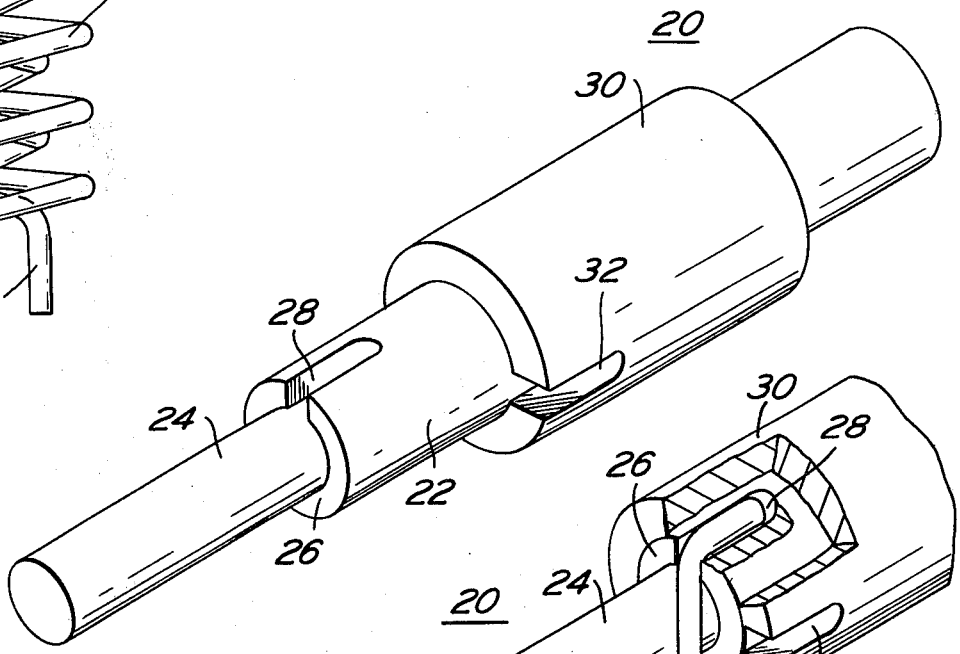
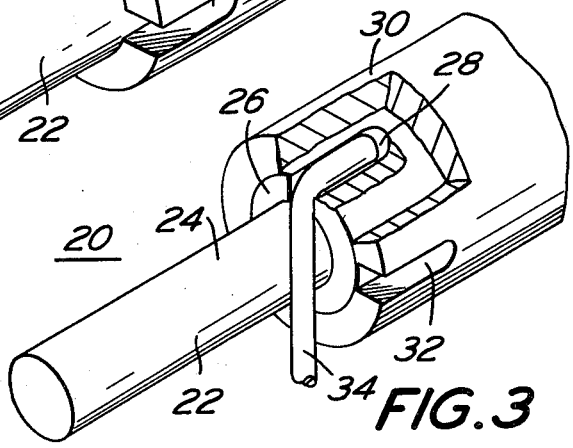
FIG. 3
FIG. 4
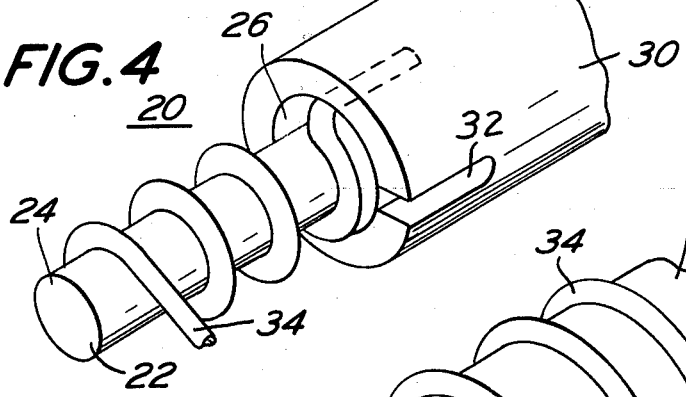
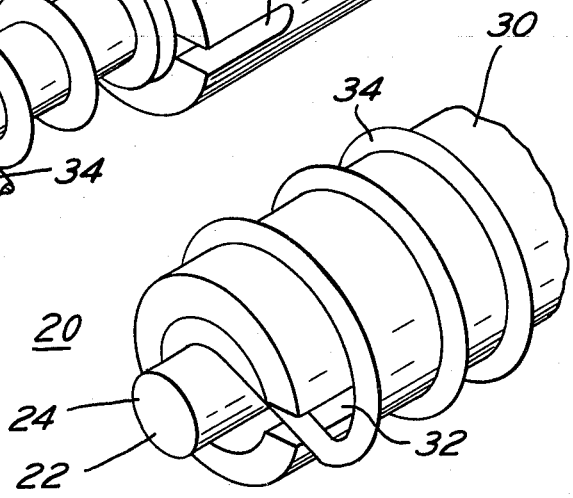
FIG. 5

TUNABLE AIR COIL INDUCTOR

The present invention relates to an air core inductor coil and particularly to an air core inductor having both terminals at one end. Also, the present invention relates to a method and apparatus for making the inductor coil.

In constructing circuitry utilizing air core inductor coils, it is desirable to mount adjacent inductor coils at right angles to each other in order to minimize inter-inductor coupling. Such assemblies can be made more compact if three mutually perpendicular planes can be utilized for mounting the inductor coils. When the circuitry is mounted on a printed circuit board, the only way of mounting the inductor coils along three mutually perpendicular planes is to be able to mount one inductor coil in a vertical plane. However, the presently available straight inductor coils which are merely helical coils with a terminal at each end are not readily mountable in a vertical position on a printed circuit board. Also, such inductor coils are not conducive to tuning by separating the turns of the coils since this would change the distance between the terminals and they would not then fit into the openings in the printed circuit board.

Therefore, it is an object of the present invention to provide a novel air core inductor coil.

It is another object of the present invention to provide an air core inductor coil which can be tuned by expanding or compressing the coil without changing the spacing between the terminals of the coil.

It is a further object of the present invention to provide a method and apparatus for making the inductor coil of the present invention.

Other objects will appear hereinafter.

The invention accordingly comprises the several steps and the relation of one or more of such steps with respect to each of the others, the apparatus embodying features of construction, combination and arrangement of parts which are adapted to effect such steps, and the article which posses the characteristics, properties and relation of elements, all as exemplified in the detailed disclosure hereinafter set forth, and the scope of the invention will be indicated in the claims.

For a fuller understanding of the nature and objects of the invention reference should be had to the following detailed description taken in connection with the accompanying drawing in which:

FIG. 1 is a perspective view of the air core inductor coil of the present invention.

FIG. 2 is a perspective view of an apparatus for making the inductor coil shown in FIG. 1.

FIGS. 3–5 are perspective views illustrating the steps of making the inductor coil of FIG. 1 on the apparatus shown in FIG. 2.

Referring initially to FIG. 1, an air core inductor coil of the present invention is generally designated 10. The inductor coil 10 comprises a first helical coil section 12 and a second helical coil section 14 surrounding and extending along in spaced relation to the first helical coil section 12. Thus, the first and second coil sections 12 and 14 extend along the same longitudinal axis with the first coil section 12 being within the second coil section 14. The first and second coil sections 12 and 14 are electrically and mechanically connected at one end of the sections, and have terminals 16 and 18 respectively extending from their other ends. The terminals

16 and 18 are spaced apart and extend substantially parallel to the longitudinal axis of the coil 10. The coil sections 12 and 14 and the terminals 16 and 18 are formed of a single, continuous length of a wire of an electrically conductive metal. Preferably, each of the coil sections 12 and 14 has the same number of coil turns and is of the same length along the axis of the coil. However, if desired, one of the coil sections can have a different number of turns than the other coil sections. The turns of the two coil sections 12 and 14 are wound in the same direction.

Thus, the inductor coil 10 has both of its terminals 16 and 18 at the same end of the coil with the terminals being substantially parallel to the longitudinal axis of the coil. This permits the inductor coil 10 to be mounted on a printed circuit board with the longitudinal axis of the coil extending substantially perpendicular to the board. Thus, the inductor coil 10 will not only utilize less area of the printed circuit board, but also can be mounted in closely spaced relation to other standard coils whose axis is parallel to the board. In addition, the inductance of the inductor coil 10 of the present invention can be tuned by compressing or separating the turns of the coil sections without affecting the spacing between the terminals 16 and 18. Therefore, the inductor coil 10 can be tuned without affecting its ability to be mounted on a printed circuit board. In fact, the inductor coil 10 can be tuned after it is mounted on the printed circuit board.

Referring to FIG. 2, an apparatus for making the inductor coil 10 is generally designated as 20. Apparatus 20 comprises a cylindrical body 22 having a first cylindrical winding portion 24 in longitudinal alignment with the body 22. The first winding portion 24 is smaller in diameter than the body 22 so as to provide a shoulder 26 at the junction therebetween. The first winding portion 24 is of a diameter equal to the inner diameter of the first coil section 12 of the inductor coil 10, and the body 22 is of a diameter equal to or slightly larger than the outer diameter of the first coil section 12. The body 22 has a slot 28 therein extending longitudinally therealong from the shoulder 26. The slot 28 is of a depth at least equal to the diameter of the wire used to make the inductor coil 10 and is of a length at least equal to the length of the terminal 16 of the first coil section 12. A second winding portion 30 in the form of a cylindrical sleeve surrounds the body 22 and is slidable longitudinally along the body 22 and over the first winding portion 24. The outer diameter of the second winding portion 30 is equal to the inner diameter of the second coil section 14 of the inductor coil 10. The second winding portion 30 has a notch 32 in its end.

To make an inductor coil 10 of the present invention using the apparatus 20, the end portion of a length of wire 34 is placed in the slot 28 in the body 22 with the end of the wire being adjacent the blind end of the slot 28. The second winding portion 30 is slid over the end portion of the wire as shown in FIG. 3. This holds the end portion of the wire, which will be the terminal 16, in the slot 28 with the end portion extending substantially parallel to the longitudinal axis of the body 22. The wire 34 is then wound helically around the first winding portion 24 from the shoulder 26 toward the free end of the first winding portion 24 as shown in FIG. 4. The wire 34 is wound around the first winding portion 24 for the number of turns desired for the first coil section 12.

The second winding portion 30 is then slid longitudinally over the first winding portion 24 so as to surround and hold in place the windings of the wire 34 on the first winding portion 24. The wire 34 is then passed through the notch 32 in the second winding portion 30 and wound helically around the second winding portion 30 back toward the body 22 as shown in FIG. 5. The wire 34 is wound around the second winding portion 30 for the number of turns desired for the second coil section 14, which is generally equal to the number of turns of the first coil section 12. The wire 34 is then bent to extend substantially parallel to the longitudinal axis of the body to form the terminal 18. The second winding portion 30 is then slid longitudinally back over the body 22 from between the two coil sections and the inductor coil 10 is removed from the apparatus 20.

Thus, there is provided by the present invention an air core inductor coil 10 having both of its terminals at one end of the coil with the terminals extending substantially parallel to the longitudinal axis of the coil. This permits the coil to be mounted on a printed circuit board with the longitudinal axis of the coil being substantially perpendicular to the printed circuit board. Also, the inductor coil of the present invention can be easily tuned by compressing or expanding the turns of the coil without changing the spacing between the terminals of the coil. This can even be achieved after the inductor coil is mounted on a printed circuit board. The present invention also provides an apparatus and method whereby the inductor coil can be easily and quickly formed from a single length of wire by winding one coil section directly around the other coil section.

It will thus be seen that the objects set forth above, among those made apparent from the preceding description, are efficiently attained and, since certain changes may be made in carrying out the above process, in the described product and in constructions set forth without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therewithin.

What is claimed is:

1. A tunable air core inductor coil for mounting on a printed circuit board comprising a first helical coil section having a cylindrical form, a second helical coil section having a cylindrical form and positioned around and radially spaced from the first coil section, said coil sections being electrically connected at one adjacent end of the sections, a terminal extending from the other end of each of the coil sections with said terminals being substantially parallel to the longitudinal axis of the coil sections, each of said coil section being wound continuously in the same direction from one terminal to the other terminal, the two coil sections, the electrical connection therebetween, and the terminals being of a single, continuous length of solid wire of constant diameter and low resistance which is supported only by its own rigidity, whereby the coil can be turned by adjusting its length by means of expanding or compressing the coil without changing the spacing between the terminals of the coil.

2. An inductor coil in accordance with claim 1 in which the two coil sections include the same number of turns.

3. A tunable air core inductor coil supported on a printed circuit board comprising a first helical coil section having a cylindrical form, a second helical coil section having a cylindrical form and positioned around and radially spaced from the first coil section, said coil sections being electrically connected at one adjacent end of the sections, a terminal extending from the other end of each of the coil sections with said terminals being substantially parallel to the longitudinal axis of the coil sections, each of said coil sections being wound continuously in the same direction from one terminal to the other terminal, the two coil sections, the electrical connection therebetween, and the terminals being of a single, continuous length of solid wire of constant diameter and low resistance which is supported only by its own rigidity, and said terminals electrically connected to said printed circuit board, whereby the coil can be tuned by adjusting its length by means of expanding or compressing the coil without changing the spacing between the terminals of the coil.

4. An inductor coil and printed circuit board in accordance with claim 3 in which the two coil sections include the same number of turns.

* * * * *